US009872557B2

(12) United States Patent
Jensen

(10) Patent No.: US 9,872,557 B2
(45) **Date of Patent: *Jan. 23, 2018**

(54) DELIVERY TIP FOR FLOWABLE MATERIALS

(75) Inventor: Steven D. Jensen, South Jordan, UT (US)

(73) Assignee: CAO Group, Inc., West Jordan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/686,366

(22) Filed: Jan. 12, 2010

(65) Prior Publication Data

US 2010/0111591 A1 May 6, 2010

Related U.S. Application Data

(63) Continuation-in-part of application No. 11/743,115, filed on May 1, 2007, now Pat. No. 7,645,086, which is a continuation-in-part of application No. 11/567,367, filed on Dec. 6, 2006, now Pat. No. 7,476,049.

(51) Int. Cl.

| | |
|---|---|
| ***A46B 3/00*** | (2006.01) |
| ***A45B 7/00*** | (2006.01) |
| ***A46B 11/00*** | (2006.01) |

(52) U.S. Cl.

CPC ..... *A46B 11/0041* (2013.01)

(58) Field of Classification Search

CPC ..... A46D 11/001; A46D 3/00; A46D 3/08; A46D 3/10; A46D 3/20; A46D 9/08; A46D 9/12; A46B 3/00; A46B 7/00; A46B 11/0041

USPC ..... 401/268, 270, 290; 300/4, 5, 8; 15/205.2

See application file for complete search history.

(56) References Cited

U.S. PATENT DOCUMENTS

| | | | | |
|---|---|---|---|---|
| 428,023 | A | 5/1890 | Schoff | |
| 637,631 | A * | 11/1899 | Marsh | 401/229 |
| 752,078 | A * | 2/1904 | Burt et al. | 401/276 |
| 931,881 | A | 8/1909 | Marr | |
| 953,452 | A | 3/1910 | Woodmansee | |
| 1,960,387 | A * | 5/1934 | Marcher | 401/99 |
| 2,959,801 | A | 11/1960 | Pelham | |
| 3,378,331 | A | 4/1968 | Beasley | |
| 3,477,447 | A | 11/1969 | Eldredge | |
| 4,066,367 | A | 1/1978 | Sherosky | |
| 4,990,016 | A * | 2/1991 | Seidler | 401/268 |
| 4,997,371 | A | 5/1991 | Fischer | |
| 5,269,684 | A | 12/1993 | Fischer | |
| 5,294,207 | A * | 3/1994 | Keating et al. | 401/288 |
| 5,403,107 | A * | 4/1995 | Griffith et al. | 401/271 |

(Continued)

*Primary Examiner* — David Walczak

(57) ABSTRACT

A delivery tip for flowable materials with bristles or fibers extending therefrom. The tip is a cannula with a tapered outlet and features a bristle or fiber bundle with a binding restriction member that interfaces with the cannula at some point within the cannula but has a smaller cross-sectional area for flow passage than the cannula at that point. The bristle or fiber bundle extends out of the tapered outlet. The delivery tip may connect to a material reservoir with flowable material. When positive pressure is applied to the reservoir, material then will flow through the cannula, around the restriction member, into the bristles or fibers and out the outlet for distribution to a desired surface.

3 Claims, 9 Drawing Sheets

(56) References Cited

U.S. PATENT DOCUMENTS

| | | | | |
|---|---|---|---|---|
| 5,816,804 | A | 10/1998 | Fischer | |
| 5,829,976 | A | 11/1998 | Green | |
| 5,908,257 | A | 6/1999 | Martin | |
| 6,038,002 | A | 3/2000 | Song | |
| 6,049,934 | A | 4/2000 | Discko | |
| 6,059,570 | A | 5/2000 | Dragan | |
| 6,158,442 | A | 12/2000 | Piatesky | |
| 6,238,120 | B1 | 5/2001 | Mark | |
| 6,315,483 | B1 * | 11/2001 | Velliquette | 401/278 |
| 6,382,972 | B1 | 5/2002 | Fischer | |
| 6,390,817 | B1 * | 5/2002 | Jensen | 433/89 |
| 6,537,239 | B2 | 3/2003 | Mark | |
| 6,585,511 | B2 | 7/2003 | Dragan | |
| 6,648,376 | B2 | 11/2003 | Christianson | |
| D496,999 | S | 10/2004 | Dragan | |
| D504,948 | S | 5/2005 | Dragan | |
| 6,957,958 | B2 | 10/2005 | Rowe | |
| 6,988,892 | B2 | 1/2006 | Dragan | |
| 7,040,893 | B2 | 5/2006 | Fischer | |
| D527,457 | S | 8/2006 | Dragan | |
| 7,179,085 | B2 | 2/2007 | Dorsey | |
| 7,198,623 | B2 | 4/2007 | Fischer | |
| 2005/0239015 | A1 | 6/2005 | Dragan | |

* cited by examiner

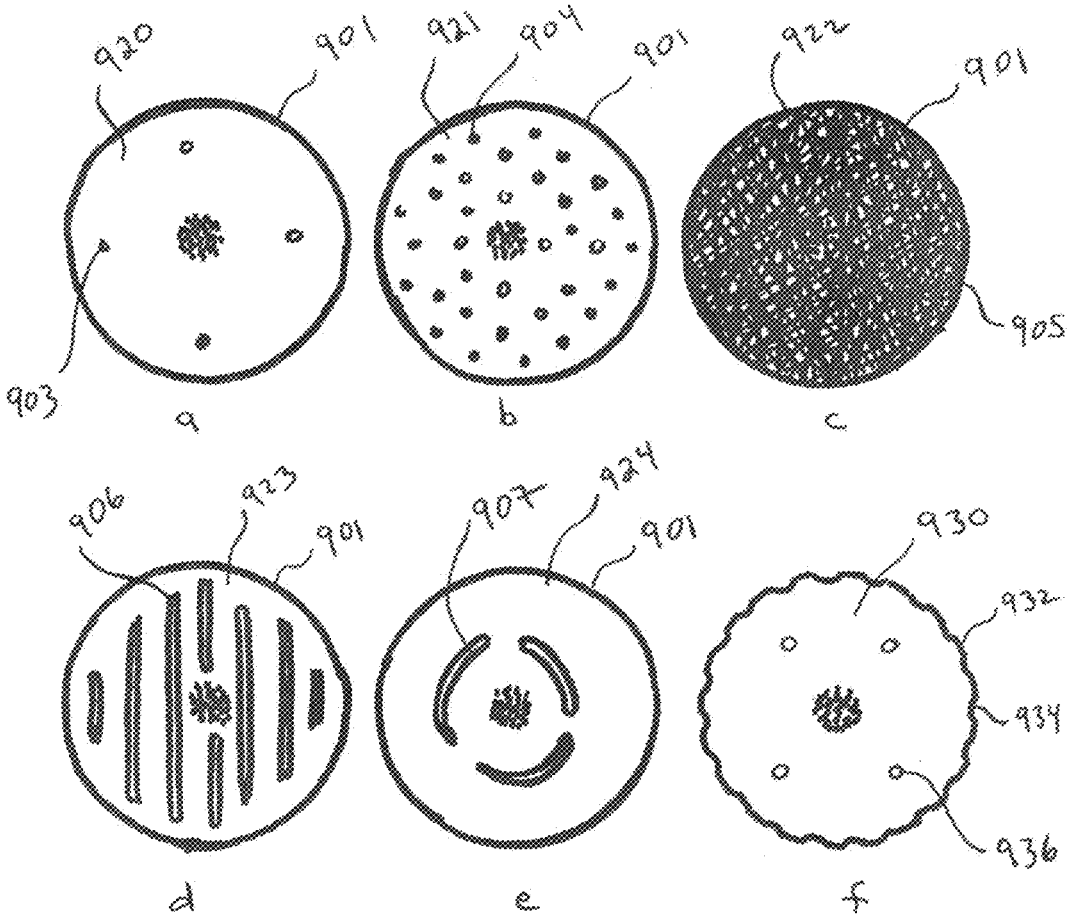
Figures 9a-f

DELIVERY TIP FOR FLOWABLE MATERIALS

CROSS-REFERENCE TO RELATED APPLICATIONS

This application claims the benefit of U.S. patent application Ser. No. 11/743,115, filed May 1, 2007, now U.S. Pat. No. 7,645,086, which is a continuation in part of U.S. patent application Ser. No. 11/567,367, now U.S. Pat. No. 7,476,049 filed Dec. 6, 2006, the entirety of each being incorporated herein by reference.

TECHNICAL FIELD OF THE INVENTION

The present invention relates to the field of devices used to dispense flowable materials and, more particularly, to the field of flowable material delivery tools and components thereof having brush tips to aid in dispensing such flowable materials.

BACKGROUND OF THE INVENTION

Brush tips for dispensing material, particularly in medical and dental fields, are known in the prior art. Usually such tips provide a flocked spreading means or some form of bristling for application of the material as dispensing occurs. The prior art demonstrates that such means are mounted on the external surface of the syringe, tools, or other apparatus used to dispense or distribute the material. Unfortunately, these prior methods have a number of difficulties. The first is the potentially meticulous process of mounting the flocked and fibrous spreading means. The second is the potential for a weaker hold of the device on such means while in use, i.e. shedding. The third is the potential for clogging the external fibrous spreading means, which usually accompanies more secure binding of the fibrous spreading means. Therefore, prior art devices have had to strike a balance between acceptable shedding and acceptable flow.

The present invention is a delivery tip mountable upon a material containment or dispensing means which contains bristles internally in a bundle. The bristles are bound by a restriction member that is inserted and resides within a narrowing cannula. The restriction member is positioned within the cannula at a point where a major axis of the member matches a major axis of the cannula, but where a minor axis of the member is smaller than a corresponding minor axis of the cannula. The bristles extend from the restriction member out of a narrow tip of the cannula while the opposing end of the cannula is configured to attach to and engage a containment structure. The present invention represents a departure from the prior art in that the bristled delivery tip allows for more secure bundling of the bristles while simultaneously allowing for effective and accurate distribution of the flowable material.

SUMMARY OF THE INVENTION

In view of the foregoing disadvantages inherent in the known types of delivery means, this invention provides an improved bristled delivery means for fluidic materials. As such, the present invention's general purpose is to provide a new and improved delivery tip that is readily attachable to known and later developed containment structures and that provides secure hold of fiber bundles while not hindering fluidic discharge of material.

To accomplish these objectives, the delivery tip comprises a cannula with a delivery tip, a bundle of fibers disposed within the cannula and extending from the delivery tip, and a restriction member not having the same cross-section as the cannula while binding the bundle of fibers. The relationship between the restriction member and the cannula is such that at some point along the body of the cannula the restriction member is engaged with the cannula and has a cross sectional surface area less than the cross sectional area of the cannula at the point of engagement. Attachment means to a source or reservoir of flowable or fluidic material should also be provided, but those exact means will be dependent upon the means used on the reservoir (e.g. mating threaded means, leur lock, snap-fit, etc.).

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIGS. 9*a*-9*f* are top plan views of example restriction members having various internal passages.

DETAILED DESCRIPTION OF THE INVENTION

Figure 1:
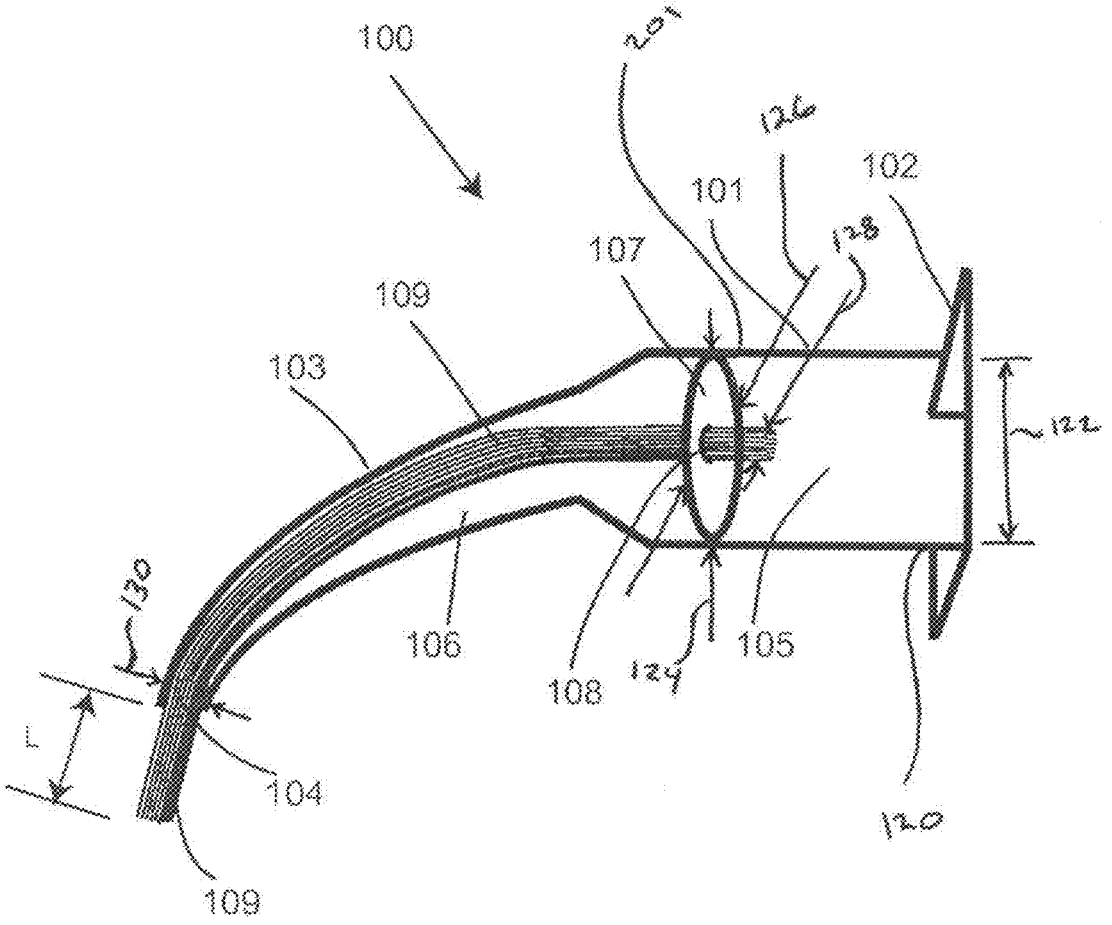
FIG. 1 is a transparent side plan view of one embodiment of the present invention, using a luer lock connection means.

With reference now to the drawings, various embodiments of the inventive delivery tip are herein described. With reference to FIG. 1, a brush tip 100 according to the present invention is illustrated having a cannula 101 of varying cross-sectional dimension and a luer lock 102 disposed at a first end 120 configured to attach to and engage a containment structure (not illustrated). The cannula 101 exhibits varying cross section along its length, starting with a first opening proximate the first end 120 and decreasing to a small opening relative to the first opening proximate a second or outlet end 104. The cannula 101 includes an interior bulk portion 105 proximate the first end 120 and a graded interior portion 106 that extends from the bulk portion 105 to the second or outlet end 104; the graded interior portion 106 varies in cross section along an arc length from the bulk interior portion 105 to the second or outlet end 104.

Still referring to FIG. 1, a fiber bundle 109 is threaded through the graded interior portion 106 of the cannula 101 and extends just outside the second or outlet end 104. The fiber bundle 109 is inserted through and bound within an interior region 108 of a restriction member 107. The restriction member 107 is inserted into the interior bulk portion 105 and urged against an interior portion of the cannula 101 where a major axis 124 of the restriction member 107 matches a major axis 122 of the interior surface of the cannula 101, but where a minor axis 126 of the restriction member 107 is smaller than a corresponding minor axis of the cannula 101; if the bulk portion 105 has a circular cross section, the minor axis of the cannula 101 will be equal in length to the corresponding major axis 122 of the cannula 101. The diameter 128 of the fiber bundle 109 is smaller than the inner diameter 130 of the second or outlet end 104 and extends beyond the outlet 104 a length L. In one embodiment, the length L of the fiber bundle 109 extending from the outlet 104 is equal to or greater than 0.5 mm, although any length is possible depending on the requirements of the desired use.

Figure 2:
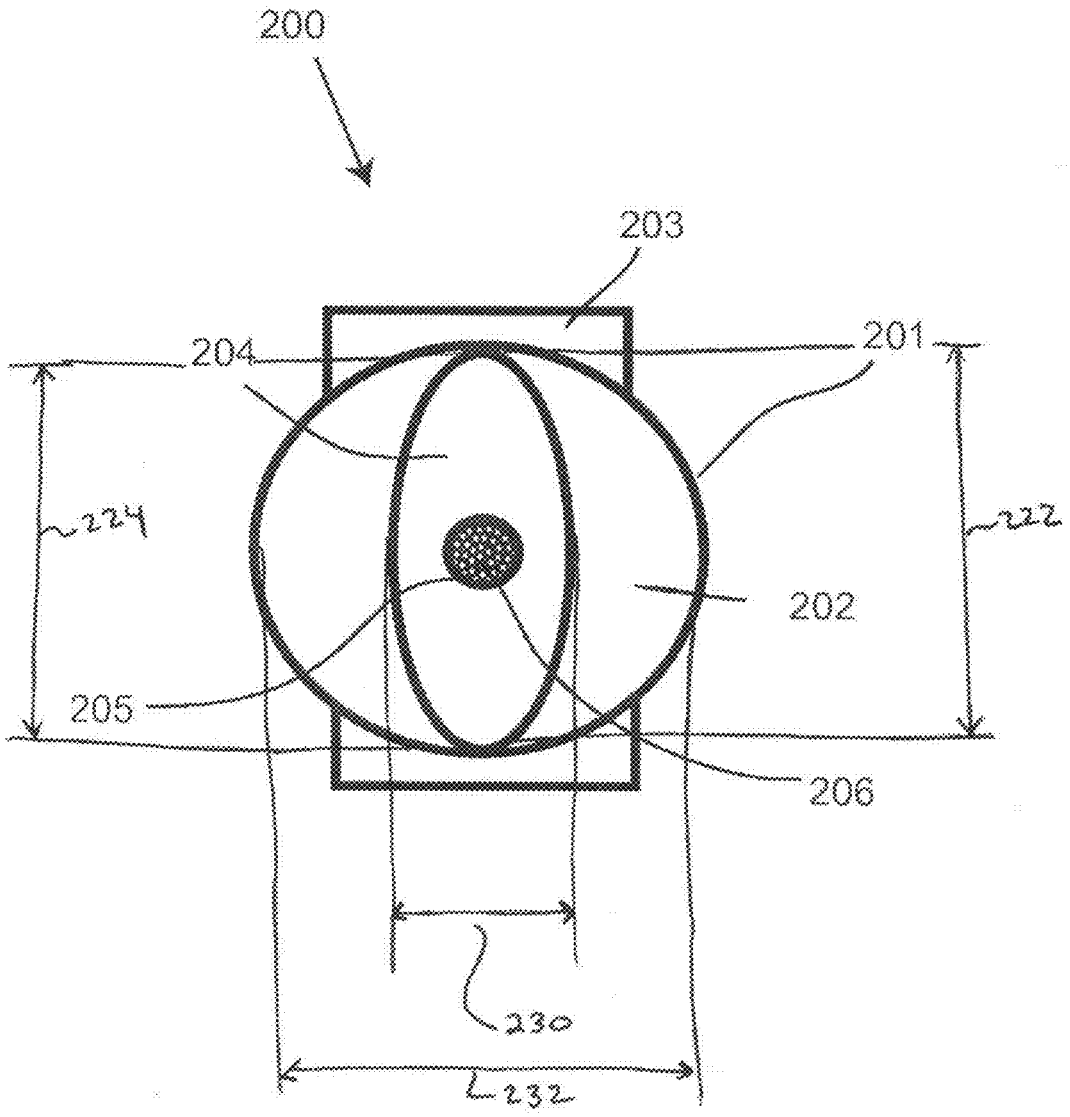
FIG. 2 is a real plan view of the embodiment depicted in FIG. 1.

Referring now to FIGS. 1 and 2, an end view of the invented tip 200 illustrates a wall surface 201 of the interior bulk portion 105 which defines an open space 202 inside the cannula 201. A luer lock thread 203 is positioned proximate the first end 120 of the cannula 101. The restriction member, here illustrated in the form of an elliptical disk 204, engages the wall surface 201 of cannula 101 with the fiber bundle 206 (denoted 109 in FIG. 1) inserted into a hole 205. The major axis 222 of the elliptical disk 204, at the point of engagement, matches, or is slightly larger than, the major axis 224 of the wall surface 201 of the cannula 101, while the minor axis 230 is smaller than the corresponding minor axis 232 of the cannula 101. The wall surface 201 of the cannula 101 may be circular, as depicted in the figures, or may, alternatively, be of any other shape, so long as the relation required between the wall surface 201 of the cannula 101 and the restriction member 107—e.g., the elliptical disk 204—holds true—i.e., the restriction member has a smaller cross-sectional area than the cross sectional area defined by the wall surface 201 of the cannula 101, but simultaneously has a means to interface with or engage the wall surface 201 of the cannula 101.

The diameter of fiber bundle 206 is slightly larger than the diameter of the hole 205 in the restriction member. Thus, the fiber bundle 206 is securely fixed or engaged with the restriction member—e.g., the elliptical disk 204. The restriction member—e.g., the elliptical disk 204—is typically inserted into the bulk portion 105 of the cannula 101 to a point where the major axis 224 of the restriction member engages—e.g., through friction fit—with the corresponding major axis 222 of the bulk portion 105 of the cannula 101. It is noted here, that while engagement of the restriction member with the cannula is preferably accomplished through a friction fit, other means of engagement, such as, for example, adhesive or welding, are suitable for purposes of the present invention. Once engaged by whatever means, the fiber bundle 206 threads through the second or outlet end 104 of the cannula 101.

As stated previously, the restriction member 107—e.g., the elliptical disk 204—has a smaller cross sectional area that the corresponding cross sectional area of the bulk portion 105 where the restriction member 107 engages the surface wall 201 of the cannula 101. An elliptical disk, for example, permits the flowable material to flow around the disk in the regions of the minor axis 230 of the disk with little or no hindrance. Depending on the viscosity of the flowable material, the relative cross sectional areas of the bulk portion 105 and the restriction member 107 may be advantageously selected.

Figure 4:
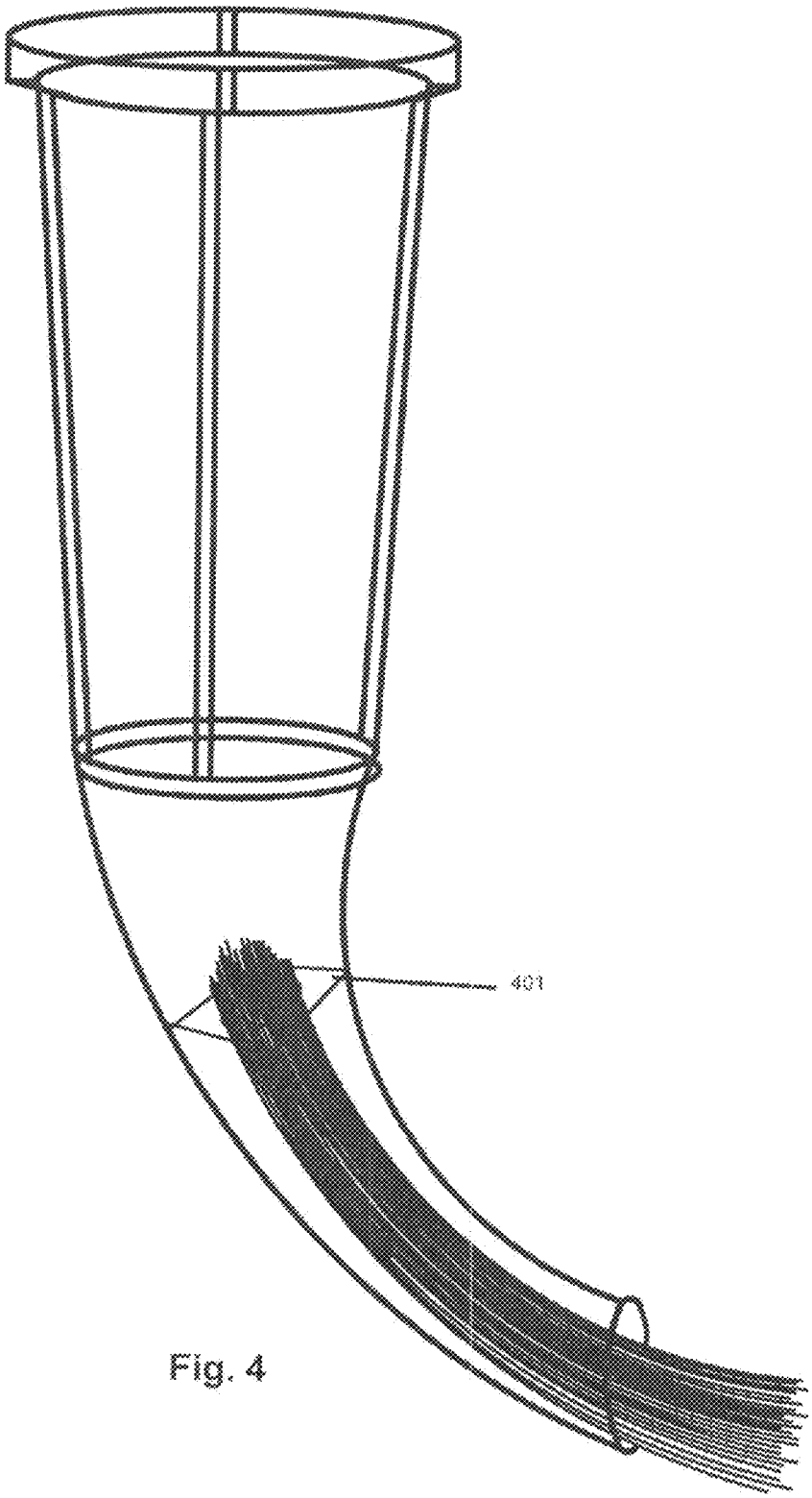
FIG. 4 is a transparent perspective view of the invention utilizing a square binding restriction member.

It should be noted that the luer lock depicted is only an example as other connection means may be used, such as a threaded interface, a snap-fitting interface, or any other interface known or later conceived in the art, without departing from the scope of the invention. It should also be noted that the restriction member—e.g., the elliptical disk—disk may be of any shape that lends itself to interfacing with the wall surface of the cannula while having a smaller cross-sectional area, such as the square member 401 illustrated in FIG. 4. All that is required is that the restriction member must make contact with the surface wall of the cannula at a given point so to be secured or engaged in place while simultaneously having a smaller cross-sectional area than the cannula at that point. As such, the term restriction member should not be seen as limited to a round or elliptical shape. FIGS. 8*a* through 8*h* illustrate eight different possible shapes (a triangle, a square, a five-pointed star, and an eight-pointed star, a hexagon, a pentagon, a rounded rectangle and a clover-like shape respectively), though any shape that meets the above referenced requirements, be they ellipses, polygons (like FIG. 8*a*, 8*b*, 8*e*, or 8*f*), star shapes (like FIGS. 8*c* and 8*d*) or other free-form shapes (like shown in FIGS. 8*g* and 8*h*) will suffice.

Figure 3:
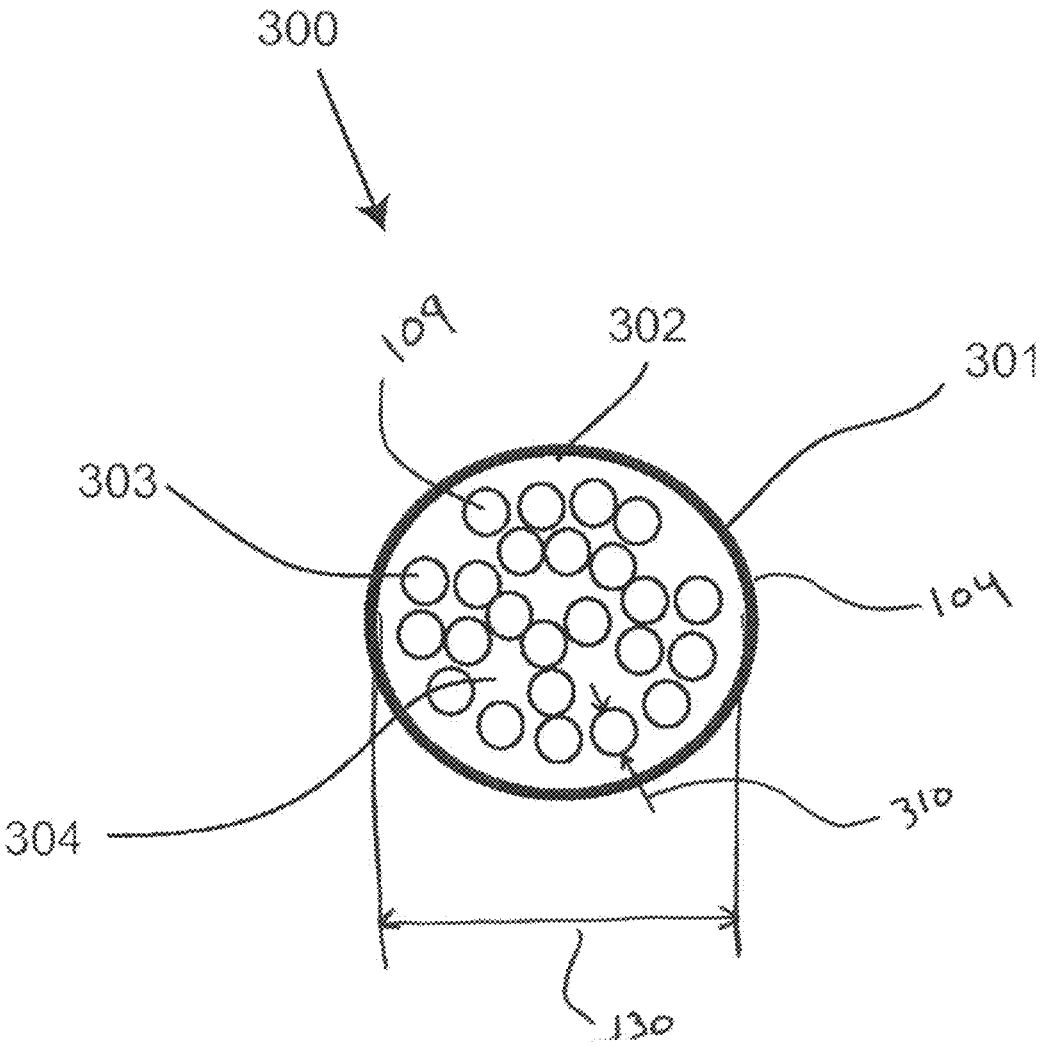
FIG. 3 is an end view of the bristled fiber bundled tip of the embodiment depicted in FIG. 1.

Referring now to FIGS. 1-3, a front plan view of the tip 300 of the cannula 101 at the second or outlet end 104 is illustrated. The fiber bundle 109 is illustrated in cross sectional view against the wall 301 of the tip 300, and is comprised of several strands or fibers 303 as illustrated. An open space(s) 304 occurs within the fiber bundle 109 as the overall diameter of fiber bundle 109 is smaller than inside diameter of the wall 301. The material will pass through the fiber bundle 109 through the space(s) 304. The total number of strands or fibers 303 of given individual diameter 310 will determine the strand density of the fiber bundle 109 and, hence, the density or average size of the space(s) 304. Therefore, by controlling the total number of fibers of given diameter 310 or variety of diameters in the bundle, the flow of the material through the cannula 101 and the tip 300 can be controlled.

Figure 5:
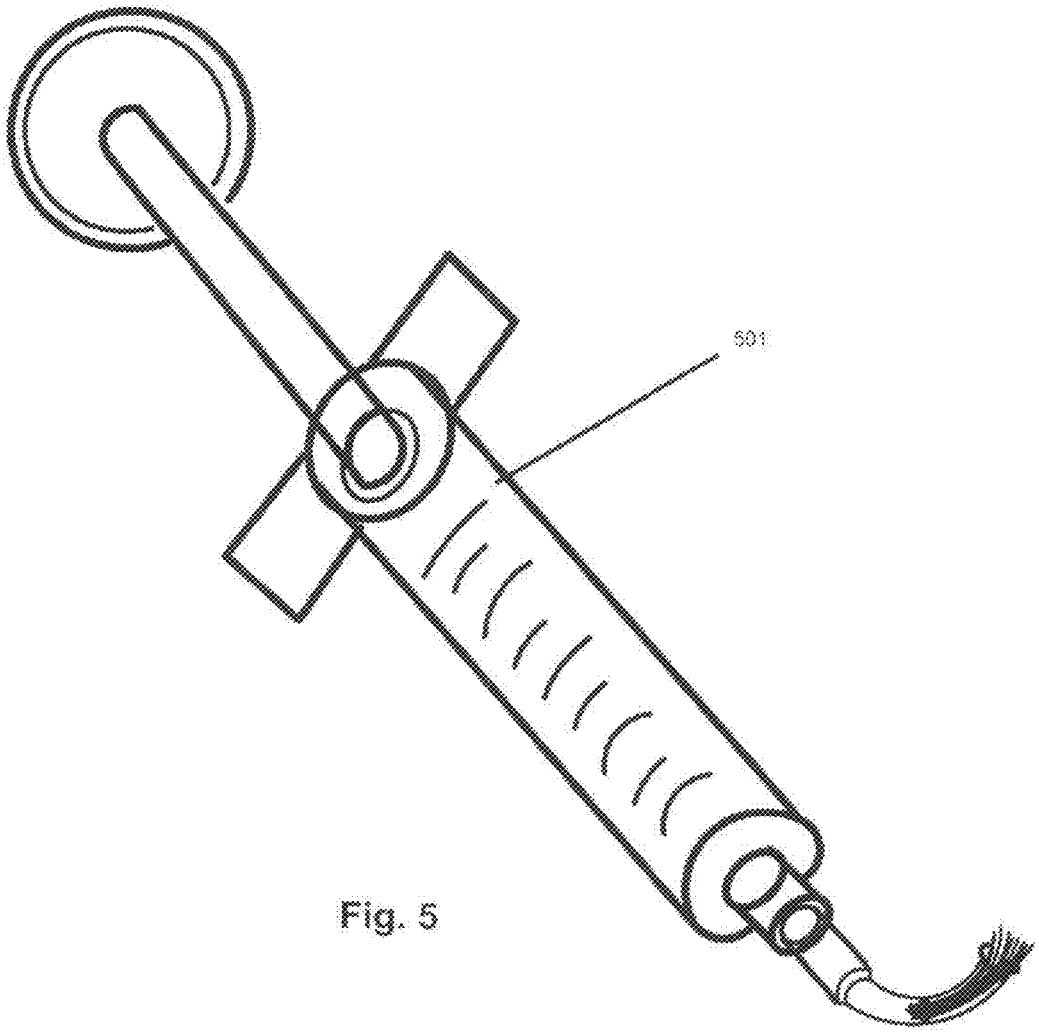
FIG. 5 is a perspective view of the invention installed on a syringe.
Figure 6:
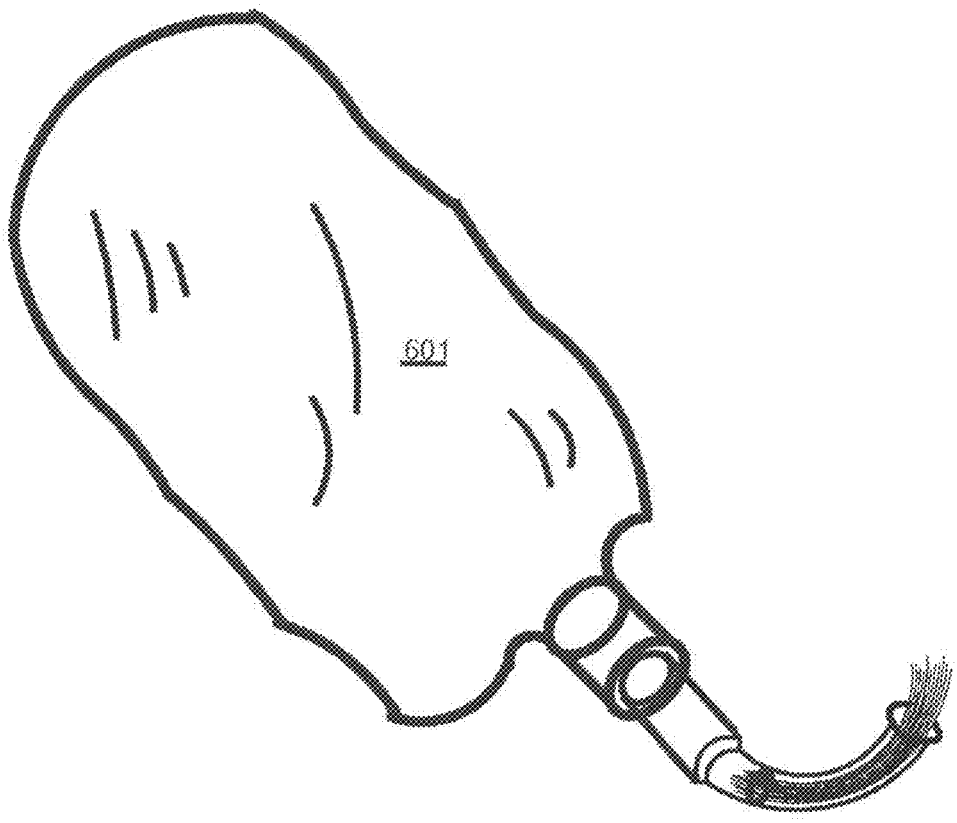
FIG. 6 is a perspective view of the invention installed on a reservoir bag.
Figure 7:
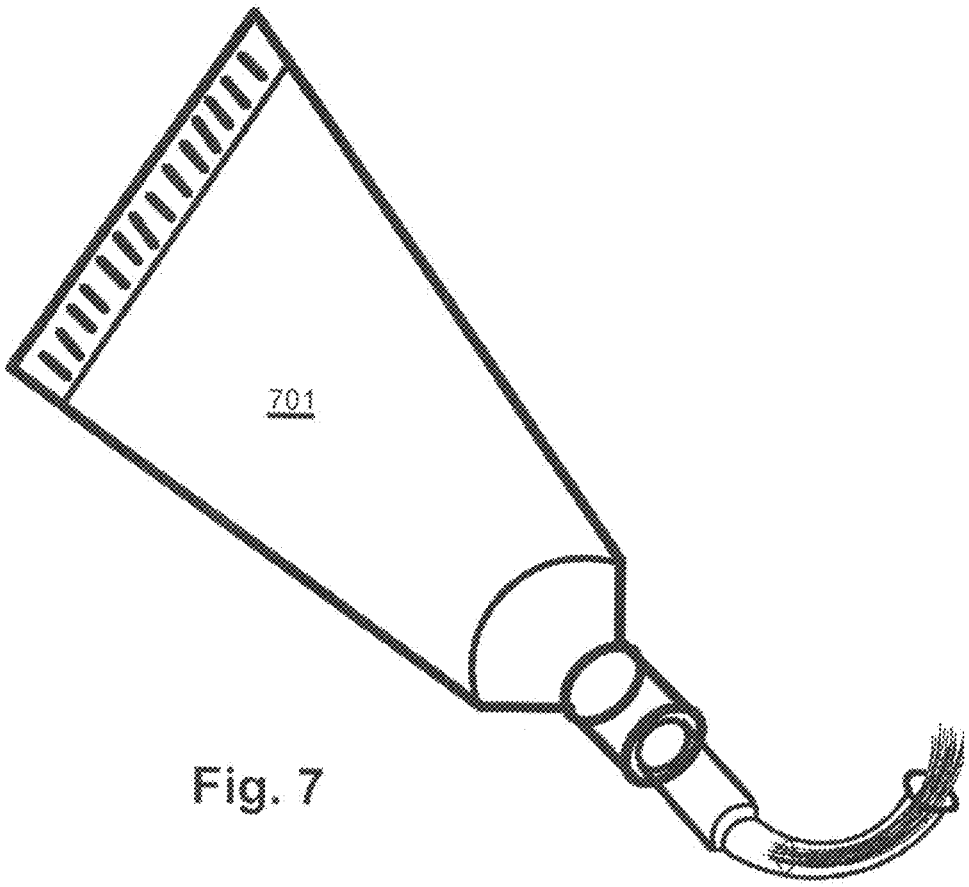
FIG. 7 is a perspective view of the invention installed on a bottle.
Figure 8A:
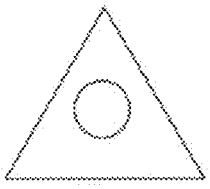
FIGS. 8*a*-8*h* are top plan views of example restriction members of varying shapes.
Figure 8B:
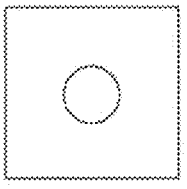
Figure 8C:
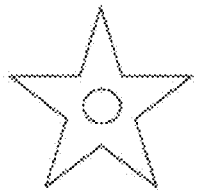
Figure 8D:
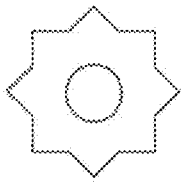
Figure 8E:
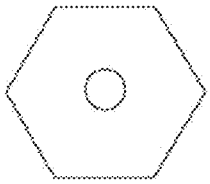
Figure 8F:
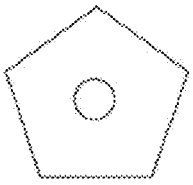
Figure 8G:
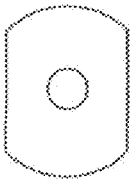
Figure 8H:
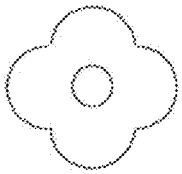

When the above described tip is attached to a syringe or other delivery device containing flowable material, for example a syringe 501, reservoir bag 601, or bottle 701 as depicted in FIGS. 5-7, a positive pressure on the flowable material relative to the external pressure at the tip outlet will cause the material to flow from the delivery device—e.g., the syringe 501—through the cannula 101, about the restriction member 107, through the fiber bundle 109 and, finally, through the outlet end 104 of the tip. Because the space(s) 304 in the fiber bundle 109 exist at the outlet end 104, the flowable material is permitted to flow through the outlet end 104, yet the fiber bundle 109 maintains its position within the tip and also its structural integrity. The extended length L of the fiber bundle 109 then acts as a brush which is used to spread or otherwise distribute the flowable material to the application surface.

Dynamics of the material flow through the cannula 101 as described—e.g., flow rate—is affected by the relative cross-sectional areas of the restriction member and the interior wall surfaces of the cannula, including the surface at the point of engagement of the restriction member 107 with the bulk portion 105 of the cannula 101, the relative dimensions of the graded portion 106 of the cannula 101 and the relative size of the space(s) 304 and the cross sectional area of the outlet end 104. The relative sizing of these various configurations of the tip may be altered for different intentions and purposes—e.g., for handling flowable materials of different viscosities. In one embodiment, it is sufficient to characterize operation of the invention as requiring, for example, a larger ratio of cross sectional area of the wall surface of the bulk portion at the point of engagement to the cross sectional area of the restriction member for flowable materials having greater viscosity than other materials. In similar characterization, a more viscous flowable material will require a larger ratio of total collective space(s) between the fibers at the tip outlet to the cross sectional area of the tip at the outlet than would a material having less viscosity.

Various further embodiments of the inventive tip are illustrated in FIGS. 9*a-e*. These embodiments comprise restriction members 920-924 having generally circular outer boundaries 901 (excluding the boundary illustrated in FIG. 9*f*). The circular outer boundaries 901 are configured to engage a corresponding circular inner wall surface 201 of the bulk portion 105 of the cannula 101. Various shaped passages 903-907 are cut out of the interior of the restriction members 920-924 to accommodate passage of the flowable material through the restriction member rather than around the outer boundary of the restriction member. In this fashion, accommodation of varying viscosities can better be had by varying the cross sectional area of the restriction members through varying the relative size of the passages 903-907 with respect to the cross sectional size of the restriction member. Indeed, in one embodiment, one or more combinations of restriction members and attached bundles of fibers are configured for removal and replacement in the tip to accommodate usages having different viscosities so that the entire tip assembly need not be disposed of following use. Referring also to FIG. 9*f*, an embodiment combining the above disclosure is illustrated. In this embodiment, a restriction member 930 comprise an outer boundary 932 having cutout portions 934 and interior passages 936 for accommodating passage of the flowable material. As with the embodiments previously described, the cutout portions 934 and interior passages 936 are sized for particular viscosities of flowable material.

While certain embodiments and details have been included herein and in the attached invention disclosure for purposes of illustrating the invention, it will be apparent to those skilled in the art that various changes in the methods and apparatuses disclosed herein may be made without departing form the scope of the invention, which is defined in the appended claims.

What is claimed is:

1. A delivery tip for flowable materials, comprising:

a cannula having a first end with a first opening, and a second end with an outlet, the cannula having a graded portion with a cross-sectional dimension that continuously decreases moving towards the outlet;

a restriction member having a cross-sectional area, the restriction member positioned completely within the cannula;

a bundle of fibers having a first end and a second end, the first end of the bundle being attached to the restriction member and the second end extending through the outlet; and an engagement point within the cannula that defines a set position of the restriction member within the cannula, where the restriction member is engaged with the cannula via at least one of an adhesive, and a weld, such that the second end of the bundle of fibers extending through the outlet has a fixed length; and wherein the restriction member is a flat disk; and wherein the restriction member has a circular shape and further comprises passages cut out of an interior portion of the restriction member.

2. The delivery tip for flowable materials recited in claim 1, wherein flowable material passes through the restriction member by way of the passages.

3. A delivery tip for flowable materials, comprising:

a cannula having a first end with a first opening, and a second end with an outlet, the cannula having a graded portion with a cross-sectional dimension that continuously decreases moving towards the outlet;

a restriction member having a cross-sectional area, the restriction member positioned completely within the cannula;

a bundle of fibers having a first end and a second end, the first end of the bundle being attached to the restriction member and the second end extending through the outlet; and an engagement point within the cannula that defines a set position of the restriction member within the cannula, where the restriction member is engaged with the cannula via at least one of an adhesive, and a weld, such that the second end of the bundle of fibers extending through the outlet has a fixed length; and wherein the restriction member is a flat disk; and wherein flowable material passes through the restriction member by way of a via other than the bundle of fibers.

* * * * *